United States Patent [19]

Griffin et al.

[11] Patent Number: 4,501,104

[45] Date of Patent: Feb. 26, 1985

[54] MULTIPACKS OF CONTAINERS

[75] Inventors: Christopher J. Griffin, London; Bernard H. Oxborrow, Swindon, both of England

[73] Assignee: Metal Box, P.L.C., Reading, England

[21] Appl. No.: 416,491

[22] Filed: Sep. 10, 1982

[51] Int. Cl.[3] ..... B65B 27/04

[52] U.S. Cl. ..... 53/48; 53/176

[58] Field of Search ..... 53/48, 176, 388, 398, 53/477, 556, 580, 585

[56] References Cited

U.S. PATENT DOCUMENTS

| | | | |
|---|---|---|---|
| 3,046,711 | 7/1962 | Harrison | 53/48 X |
| 3,057,125 | 10/1962 | Jensen et al. | 53/388 X |
| 3,488,911 | 1/1970 | Poupitch | 53/398 |
| 3,664,088 | 5/1972 | Sherman | 53/48 X |
| 3,760,554 | 9/1973 | Arneson | 53/48 X |
| 4,116,331 | 9/1978 | Curry et al. | 206/432 X |
| 4,237,676 | 12/1980 | Buckingham et al. | 53/48 X |

*Primary Examiner*—John Sipos
*Assistant Examiner*—Steven P. Weihrouch
*Attorney, Agent, or Firm*—Burns, Doane, Swecker & Mathis

[57] ABSTRACT

An apparatus for sealing cover attachments to the plastics couplers of multipacks of containers, comprising conveyor means for transporting a succession of the multipacks along a generally horizontal path, a reservoir for a plurality of the blanks, an applicator device operating in timed relation to the conveyor means to place blanks for the cover attachments individually upon the multipacks moving along the conveyor means so that tabs, which extend out from the plain portion of each blank, are disposed laterally in relation to the conveyor path and, along each side of the conveyor path, heating means for directing hot gas onto the tabs and onto the lateral surfaces of the coupler so as to render them heat-sealable together. The apparatus further comprises folding means for folding the tabs downwardly and pressure means for holding the tabs against the coupler to heat-seal the coupler and cover attachment together. The conveyor means comprises a locating side conveyor disposed to receive the multipacks with the blanks thereon downstream of the applicator means and having dog members arranged to engage individual multipacks between adjacent containers thereof, so as to locate the multipacks as they are carried in succession through the heating means, folding means and pressure means, each dog of the locating side conveyor being arranged to engage both a multipack and the respective blank thereon so as to locate the blank in relation to the multipack until the heat-seals have been made.

7 Claims, 15 Drawing Figures

MULTIPACKS OF CONTAINERS

BACKGROUND OF THE INVENTION

This invention relates to multipacks, that is to say, packages in which a plurality of articles are secured together for retailing as a single item. The invention has particular application to multipacks in which a plurality of cans, especially cans for carbonated beverages and having easy opening end closures at one end, are releasably secured together in an array by a sheet plastics coupler such as is marketed in UK under the trade name Hi-Cone (Registered Trade Mark); the coupler has apertures through which end closures of the cans are made to project, the size of the apertures being such that the cans are then tightly held in position by tension in the coupler material.

Although they are cheap to manufacture and apply, sheet plastics couplers for can multipacks suffer from the disadvantage that they are difficult to print, and moreover do not provide any substantial area on which promotional matter or technical information (e.g. a bar coding) could be printed. Furthermore, the can end closures under which the coupler is located are unprotected from dust and other contamination, therefore, particularly if they are of the easy-opening kind, these closures will often require to be cleaned if the product in the cans is to be dispensed hygenically.

It has already been proposed to provide a cover and display attachment for a container multipack having a sheet plastics coupler. The attachment is made of paperboard or like material and is in the form of a blank which is disposed to overlie the can end closures but separated from the double seams of the closures by edge portions of the coupler material formed around the container-receiving apertures in the coupler. The blank is wholly planar, being devoid of any folding or other deformation. It is attached to the coupler by heat sealing to the upper faces presented above the double seams by the above-mentioned edge portions of the coupler.

This arrangement, however, suffers from various shortcomings, both in the sealing of the attachment to the multipack and in the efficacy of the attachment in use. Among these shortcomings are the following:

(a) The formation of the edge portions of the coupler may require the coupler to be thermoformed rather than stamped. This will tend to increase manufacturing costs and reduce production rates.

(b) Because of the existence of the edge portions, the coupler no longer possesses continuous free edges which can securely lodge beneath the double seams of the containers to hold the coupler firmly in position.

(c) Engagement of the coupler beneath the container double seams takes place essentially along fold lines by which the edge portions are carried from the remainder of the coupler; any attempt to use the cover and display attachment to carry the multipack will tend to unfold these fold lines and so release the containers prematurely.

(d) It is difficult to provide the cover and display attachment with a satisfactory easy-open facility, for example tear lines in the board material, without introducing a tendancy for the attachment to tear or otherwise become damaged during normal handling, transit etc. of the multipack.

(e) The cover and display attachment is closely coupled to the underlying containers via the coupler and is therefore unable to accommodate itself to any great extent to relative movement of the containers, for example when one container is tilted or lifted in relation to the others; because of this lack of flexibility, the attachment can, in some circumstances, be inadvertently torn or detached from the coupler.

(f) Because the attachment is not folded or otherwise deformed, heat sealing is only practicable by heat conduction through the attachment material; this is inherently slow, and liable to impose a substantial limitation on the throughput of an automatic machine for assembling the attachments on a succession of the multipacks passing along a conveyor.

SUMMARY

The present invention seeks to substantially reduce or overcome at least some of the above disadvantages of the multipack arrangement described above and accordingly provides a multipack, comprising a plurality of containers in an array and having end closures at a top end thereof, a sheet plastics coupler having apertures through which the end closures project and which are dimensioned so that the containers are tightly held by tension in the coupler material, and a cover attachment formed from a blank of a heat-sealable sheet material and comprising a plane portion by which it overlies and substantially covers the end closures, and a plurality of tabs integrally joined around the periphery of the plane portion and folded downwardly in relation to the plane portion to heat sealed connection with the coupler at the outer periphery of the multipack.

The invention further seeks to provide an apparatus capable of attaching, reliably and at high speed, a plurality of the blanks of the preceeding paragraph to a succession of the said multipacks. Accordingly, from a further aspect, the invention provides apparatus for attaching blanks of a heat-sealable sheet material to multipacks each comprising a plurality of containers in an array and a sheet plastics coupler having apertures through which end closures of the containers project and which are dimensioned so that the containers are tightly held by tension in the coupler material, each blank having a plane portion by which it overlies and substantially covers the end closures of said multipack, and a plurality of tabs integrally joined to the plane portion along two opposed sides thereof and foldable downwardly in relation to the plane portion to head sealed connection with the coupler along opposed sides of the multipack, the apparatus comprising conveyor means for transporting a succession of said multipacks along a generally horizontal path, a reservoir for a plurality of said blanks, applicator means operating in timed relation to said conveyor means to place blanks individually upon said multipacks moving along said conveyor means with the tabs of said blanks disposed laterally in relation to the conveyor path and, along each side of the conveyor path, heating means for directing hot gas onto said tabs and onto the lateral surfaces of said coupler whereby to render them heat-sealable together, folding means for folding the tabs downwardly adjacent said lateral surfaces of the coupler, and pressure means for holding the tabs against the coupler to heat seal the same to one another.

DESCRIPTION OF THE PREFERRED EMBODIMENTS

Figure 1:
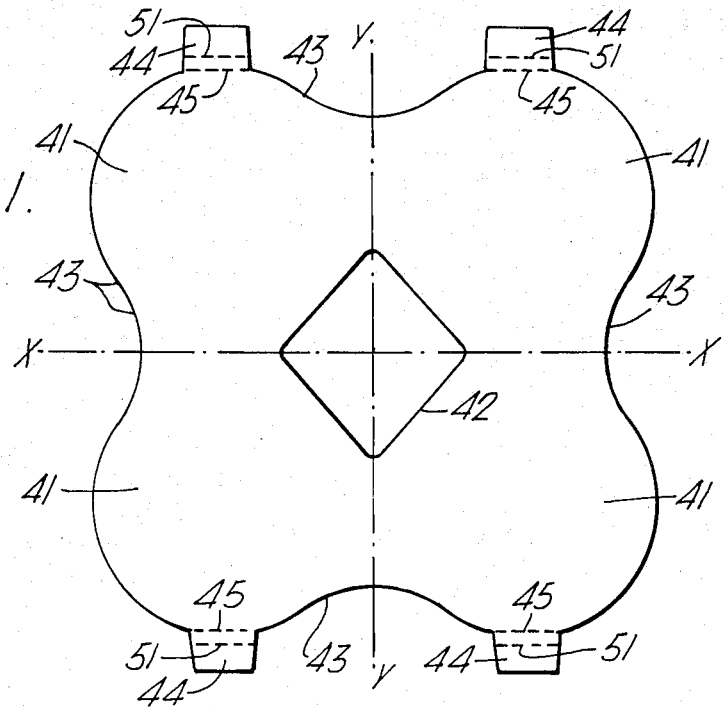
FIG. 1 shows a first blank for forming a cover and display attachment for a multipack formed of four easy-opening cans in two-by-two array, and a sheet plastics coupler attaching the cans together.

Referring now to FIG. 1, a blank of carton board sheet material is adapted to form a cover and display attachment for a multipack having four conventional easy-opening cans arranged in two-by-two array and held releasably together by a sheet plastics coupler such as is marketed in UK under the trade name Hi-Cone (Registered Trade Mark). The blank is coated on its upper side with a plastics coating of, for example, polyethylene or polypropylene to provide moisture and dust resistance. A further plastics coating on the underside of the blank enables portions of the blank to be directly heat-sealed to the coupler as will later be described.

Figure 2:
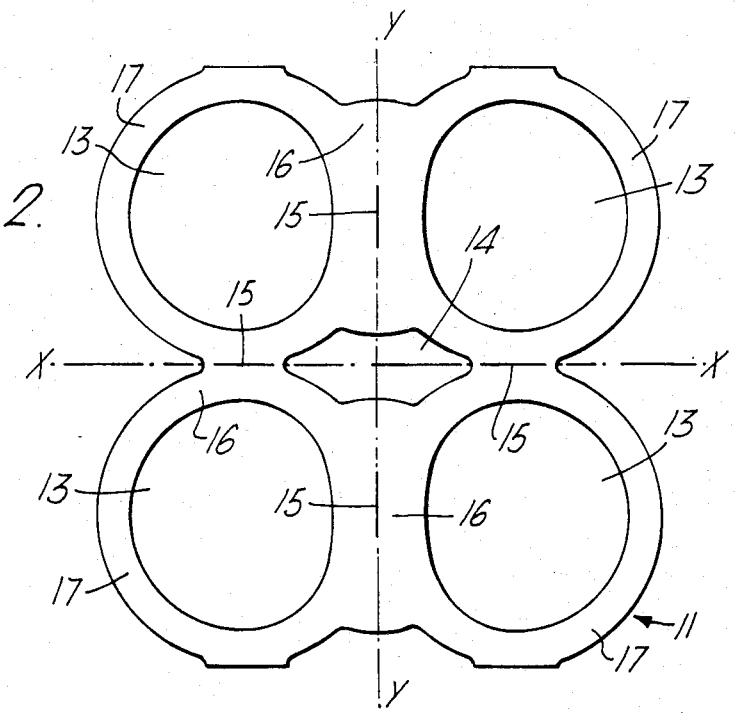
FIG. 2 shows the sheet plastics coupler of the multipack.

The coupler is shown in FIG. 2 in the plane form in which it is initially applied to the cans. In known manner the coupler has four holes 13 through which the double seams of the easy-opening end closures of the cans are to project, the coupler material around the cans then engaging generally edgewise, and with peripheral tension, beneath the double seams to hold the coupler releasably in position on the cans. Often the can bodies will be necked-in adjacent to the double seams; the coupler material around the margins of each hole 13 then substantially follows the neck contour.

In addition to the four can-receiving holes 13 previously mentioned, the coupler has a central finger aperture 14 to facilitate carrying by the user; in addition, in order to facilitate folding it has elongate creases and/or slits 15 formed along the bridges 16 joining the four lobes 17 in which the can-receiving holes 13 are formed.

Reverting again to FIG. 1, the blank has mutually perpendicular axes of symmetry XX and YY. It has four lobes 41 each disposed and dimensioned to cover one of the cans, and an access aperture 42 disposed at its center. The outer periphery of the blank between each pair of adjacent lobes 41 is, as shown, indented at 43 to assist the user to grasp the coupler between thumb and forefinger for carrying the multipack.

Figure 3:
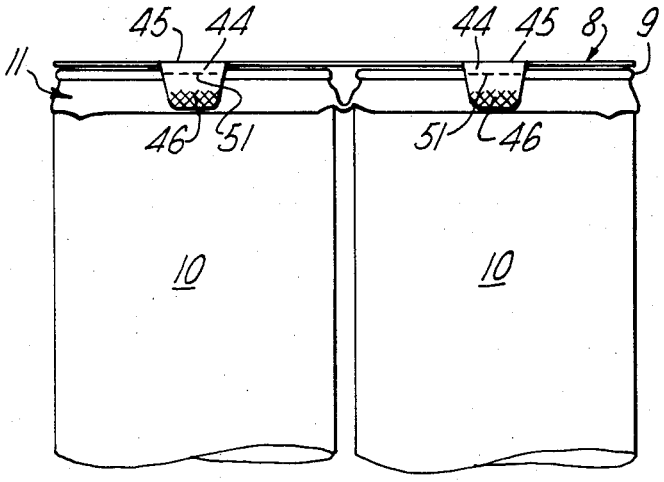
FIG. 3 is a side elevation of the multipack showing a pair of cans with the coupler and the cover and display attachment in position.
Figure 4:
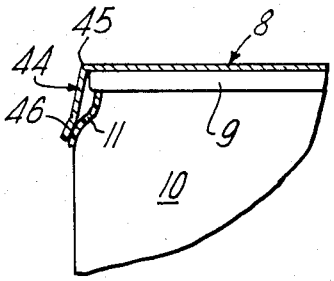
FIG. 4 shows a detail of the multipack of FIG. 3.

Each lobe 41 carries a tab 44 integrally joined along a hinge formed by a crease or score line 45, the tabs 44 being arranged in two pairs of aligned tabs on which can hereinafter be considered as side edges of the blank. In order to attach the blank to the multipack as a cover and display attachment, these tabs are downfolded through 90° and at their free ends are heat sealed directly to the coupler material below the double seams 9 of the cans, as shown in FIG. 3 where the heat seals are represented by the cross-hatched areas 46 and the attachment and coupler are generally and respectively denoted by the reference numerals 8 and 11. The detail of the heat-sealing is also shown to a greater scale in FIG. 4. It will be understood that the heat seals are formed between the plastics material of the coating on the underside of the blank and the plastics material of the coupler, these plastics materials being compatible with one another. Typically, the coating material is polypropylene, and the coupler material is high density polyethylene.

After its attachment to the multipack the blank provides a cover for the cans 10 to the point of use, its lobes 41 then lying against (or closely adjacent to) the terminal top edges of the cans provided by the double seams 9 so as to cover the easy-open closures against any substantial ingress of dust or other contamination. In addition, the attachment as a whole provides a substantial and plane area of readily printable material on which may be printed promotional matter as well as technical information such, for example, as a bar coding; the printing may be multicolor if desired. The access aperture 42 provides access to the finger aperture 14 (FIG. 2) of the coupler so that the multipack can be carried by the user by grasping it between thumb and forefinger inserted through the aperture 14. However, with suitable thickness of the board material and its plastics coatings, the attachment may be given sufficient rigidity and tensile strength to enable it, if necessary, to bear the weight of the multipack by itself.

In addition to its attachment along a hinge line 45, each tab 44 has a line of weakening 51 formed parallel to the hinge line as by creasing or scoring. The purpose of this line of weakening is to assist the tab to flex and so enable the attachment to accommodate readily to relative longitudinal movement of the cans of the multipack, in particular during carriage by the consumer. Two or more such lines of weakening 51 may be provided in parallel in each tab 44 if desired.

Figure 5:
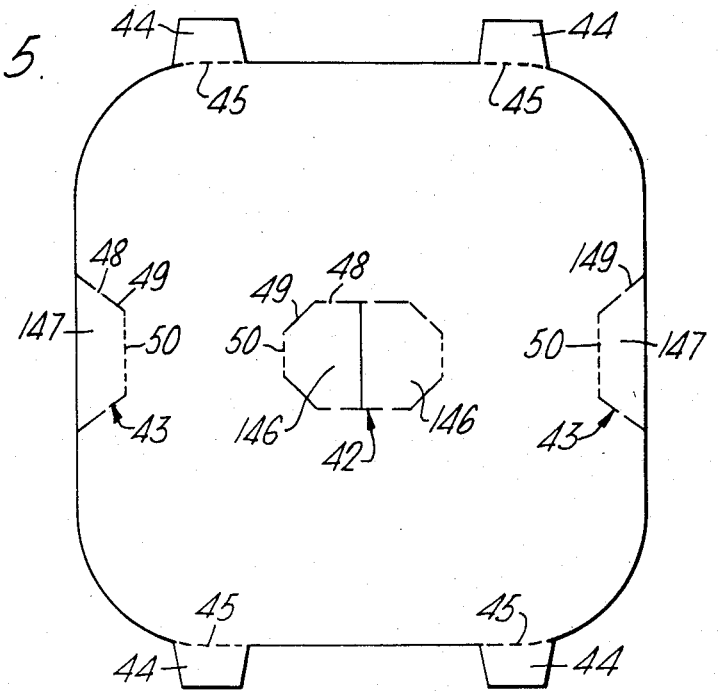
FIG. 5 shows a second blank for a cover and display attachment for a two-by-two multipack.

FIG. 5 shows a second embodiment of the invention. The cover and display attachment of this embodiment has heat-sealable tabs 44 as in the previous embodiment, but its access aperture 42 and recesses 43 are closed by panels 146, 147 so that the attachment provides tamper-evidence and a continuous display area. The panels 146, 147 are each attached by frangible bridges 48 in interrupted cut lines 49, and by hinge lines 50. The consumer may therefore tear or bend the panels 146, 147 out of the way to allow finger access to the access aperture 42 and recesses 43.

Figure 6:
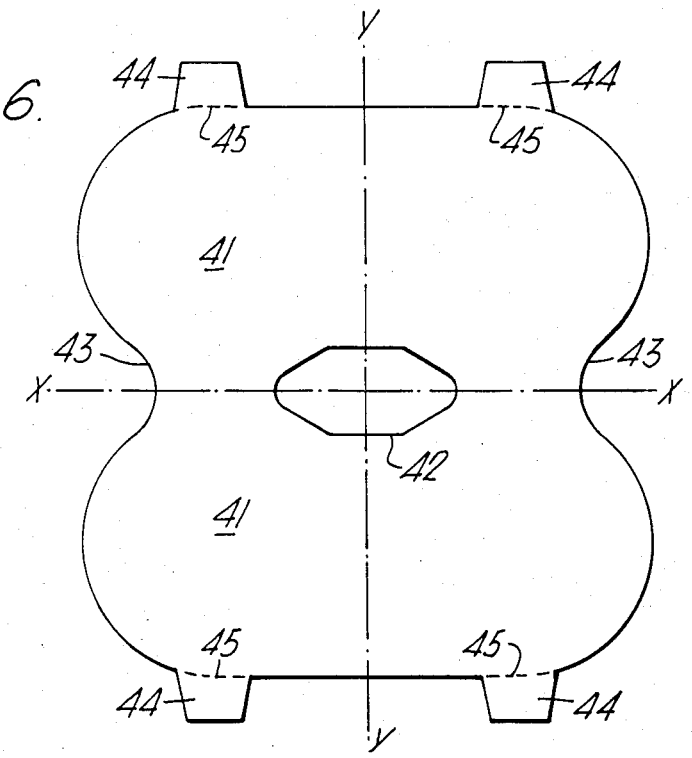
FIG. 6 shows a third blank for a cover and display attachment for a two-by-two multipack.

FIG. 6 shows an embodiment having two lobes 41 each dimensioned to cover the top of two cans 10 of a 2×2 multipack. The blank has a central access aperture 42, and two finger recesses 43. Four tabs 44 are provided, arranged in two pairs of aligned tabs each pair of which is carried by a lobe 41. In a modification which adapts the blank for attachment by the apparatus of FIGS. 8 to 11, the two pairs of aligned tabs span the recesses 43 rather than being located one to each side of them, as shown.

Figure 7:
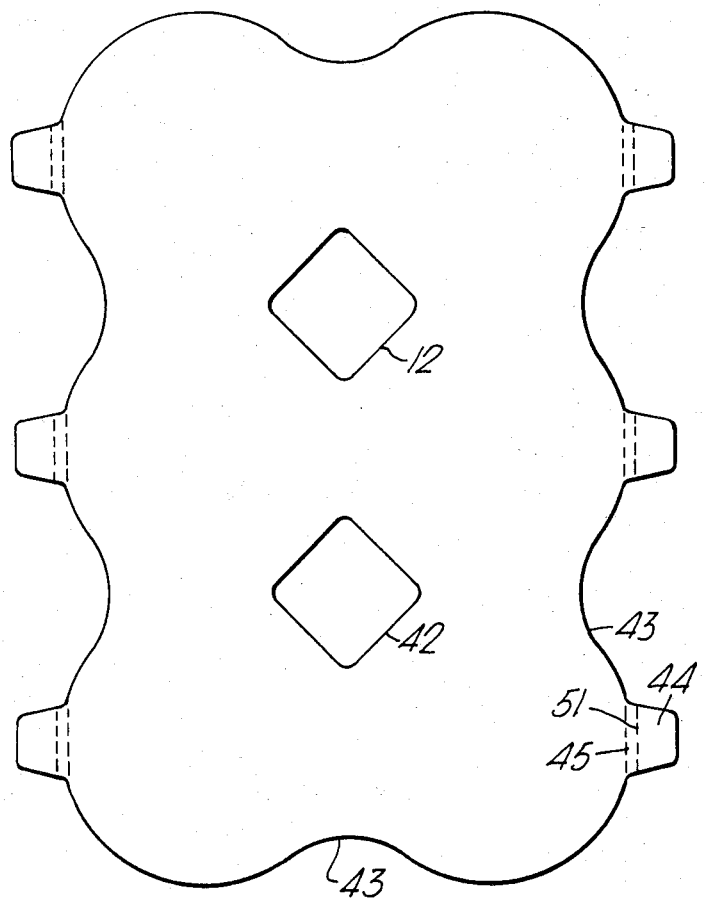
FIG. 7 shows a blank corresponding to the blank of FIG. 1 but adapted for a two-by-three multipack.

The invention is not limited in application to attachments for multipacks having a 2×2 array as particularly described above. It may be applied to multipacks having only a single row of articles or having more than two pairs of articles. FIG. 7 shows a blank for attachment to a multipack of cans arranged in 2×3 array. The blank can be readily seen to be analogous in arrangement to that of FIG. 1, and is therefore not described. As before, the blank is attached to the underlying plastics coupler by direct heat-sealing of its tabs 44. The blanks of FIGS. 5 and 6 can likewise be readily adapted for a 2×3 multipack.

Reference is now made to FIGS. 8 to 11 which illustrate the preferred apparatus and method by which the blank of FIG. 1 is positioned on the multipack and sealed in position as a cover and display attachment 8. With minor modification to the blank and/or to the apparatus, the apparatus can also be used for the cover and display attachments of FIGS. 5, 6 and 7.

Figure 8:
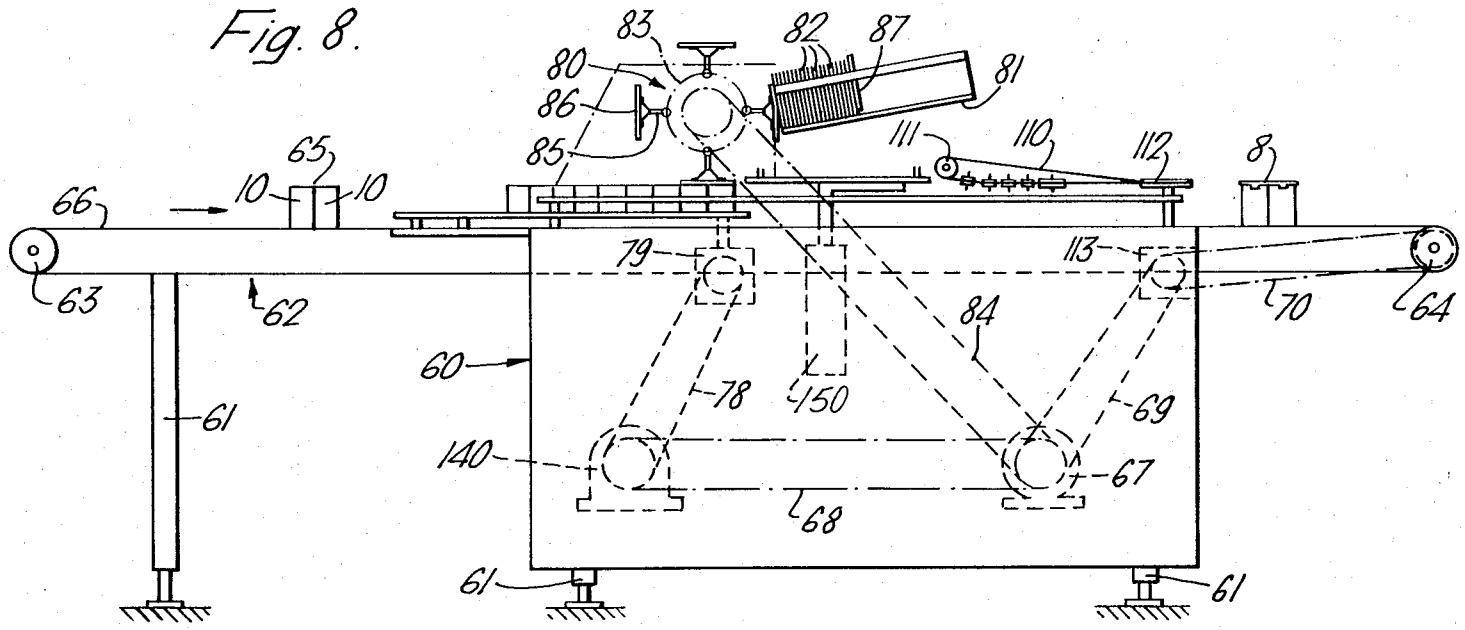
FIG. 8 shows in side elevation an apparatus for automatically positioning and sealing the blanks of FIG. 1 on two-by-two multipacks so as to form covered multipacks as shown in FIG. 3.
Figure 9:
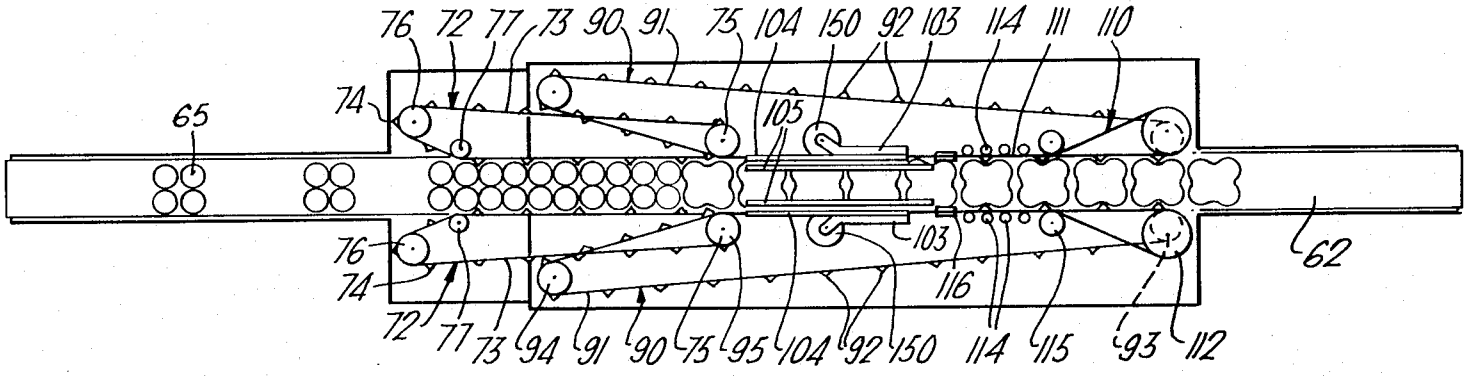
FIG. 9 shows the apparatus of FIG. 8 in a plan view.

FIGS. 8 and 9 show the apparatus respectively in diagrammatic side elevation and plan view. The apparatus has a frame 60 supported on legs 61. A belt conveyor 62 is supported by the frame to circulate between upstream and downstream rollers 63, 64, so that multipacks 65 of four cans 10 in two-by-two array can be placed on its horizontal upper run 66 and carried by the conveyor in the rightward direction as shown. For that purpose downstream roller 64 is driven in the appropriate direction by an electric motor 67 acting through chain drivers 69, 70 in series.

The multipacks 65 are placed manually or by machine on the left hand end of the conveyor 62 at a random or regular spacing. From there they are carried into the nip of a pair of metering conveyors 72. These conveyors have chains 73 on which are carried dogs 74 having a regular spacing equal to the length of one multipack 65.

The chains of the metering conveyors are trained around sprockets 75, 76, 77 mounted for rotation on vertical axes. The sprockets 75 at the downstream ends of the metering conveyors are driven by the motor 67 via a chain drive 68, mechanical clutch 140, chain drive 78 and gearbox 79, so that the opposed inner runs of the metering conveyors move in the same direction as the conveyor 62 but at a slightly lower speed. Multipacks passing between the metering conveyors are accordingly controlled by those conveyors to a predetermined speed at which they abut one another end-to-end whilst slipping slowly backwards in relation to the conveyor 62. The metering conveyors accordingly form a metering station for the apparatus.

The clutch 140 is normally engaged so that the metering conveyors are driven to feed the multipacks one-by-one into the heat-sealing station which follows. However, if for any reason the number of multipacks in and upstream of the metering station falls below a predetermined number, a switch (not shown) is automatically closed and the clutch 140 operates to stop the metering conveyors until the head of multipacks is restored whereupon the clutch is again engaged. In this way it is ensured that the multipacks are fed through the apparatus in the correct timed relation despite interruptions which may occur from time to time in the supply of multipacks to the conveyor 62.

An applicator device 80 is located above the multipack path through the apparatus at the end of the metering station. It has a magazine 81 arranged to be manually loaded with a stack of blanks 82 of the cover and display attachments with their tabs 44 disposed at the sides of the blank (in relation to the multipack path). The device 80 further comprises an applicator wheel 83 arranged for transferring the blanks in turn from the magazine to the multipacks passing beneath.

The applicator wheel 83 is rotatable about a horizontal, transverse axis. It is driven in an anticlockwise direction (FIG. 1) about this axis by means of the motor 67, and a chain drive 84. It has four take-off arms 85 with sucker heads 86 carried at 90° intervals about its periphery and connectable to a vacuum source (not shown). The rotation of the applicator wheel is synchronised with the movement of the metering conveyors 72 so as accurately to present blanks 82 drawn from the front of the magazine 81 in turn onto the multipacks passing the downstream end of the metering conveyors. For this purpose the applicator device 80 includes valving (not shown) operable with rotation of the wheel 83 to connect the take-off arms 85 in turn to the vacuum source as they approach the magazine and to subsequently disconnect the arms from the vacuum source at the moment in time when they present the blank 82 drawn from the magazine properly to a multipack 65. Moreover, the magazine has a spring-biassed retractable pusher plate 87 to engage resiliently behind the stack of blanks 82, and a suitable stop (not shown) at the front end of the magazine to hold the leading blank until it is drawn off by a take-off arm 85.

Figure 11:
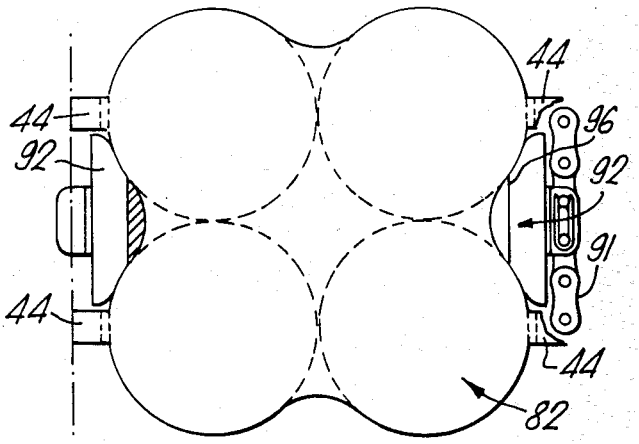
FIG. 11 is a plan view of a multipack when at the stage depicted in FIG. 10A.

After control by the metering conveyors 72 upto and under the applicator device 80, control of the multipacks passing along the conveyor 62 is taken over by two locating side conveyors 90 having chains 91 mounting dogs 92 (see also FIG. 11).

The locating side conveyors 90 have their chains trained around sprockets 93, 94, 95 for circulation in a common horizontal plane which is located above the common horizontal plane of the metering conveyors 72. The sprockets 95 of the side conveyors 90 are coaxial with the drive sprockets 75 of the metering conveyors 72 beneath them, but are free to rotate. Circulating drive for the side conveyors is provided by motor 67 acting through the chain drive 69 and a gearbox 113. The locating side conveyors 90 are operated at the same speed as the metering side conveyors 72.

The dogs 92 of the side conveyors 90 have a pitch equal to, or slightly greater than the length of one multipack. The metering and side conveyors are so synchronised that the dogs 92 engage between the cans 10 of the individual multipacks, rather than between the multipacks themselves in the manner of the dogs 74 of the metering conveyors. It will particularly be noted that the blanks 82 are placed on the multipacks by the applicator device 80 at a time when the metering conveyors still have control of the multipacks and the dogs 92 of the side conveyors are approaching, but not fully engaged with, the multipacks. This allows sufficient freedom for the blanks to be placed in position whilst ensuring that very shortly afterwards the blanks are engaged, located and held before they can be dislodged.

Figure 10A:
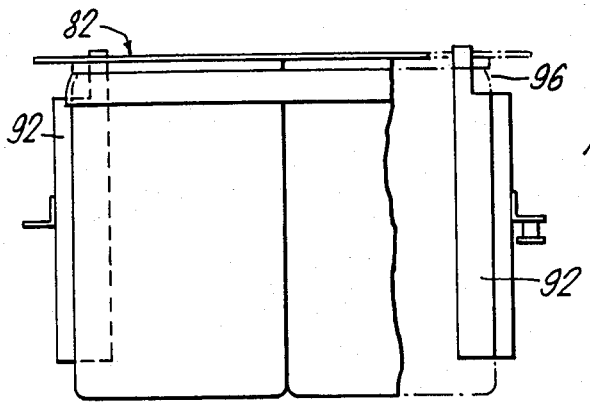
FIGS. 10A to 10E variously show different stages in the operation of the apparatus to seal the blanks to the multipacks.
Figure 10B:
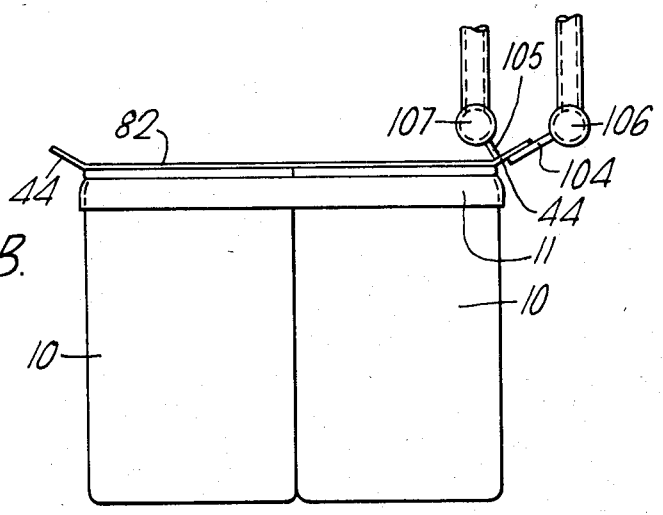

FIG. 11 in combination with FIG. 10A shows clearly the arrangement of the dogs 92 and their engagement with the multipacks. It will be seen that the dogs nest snugly in the recesses formed between the cans so as to achieve accurate lateral and longitudinal location of the multipack as the latter moves along the conveyor 62. They project upwardly beyond the cans so as by engaging the blank 82 at its side recesses 43 (FIG. 1) to locate the attachment accurately on the multipack for the tabs 44 to be bent down and heat-sealed into position. Location in the longitudinal sense is achieved by cam action of the dogs engaging the sloping surfaces of the recesses 43. Cutaways 96 are formed along the top outside edge of the dogs 92 for the purpose now to become apparent.

After engagement by the dogs 92, the multipacks 65 are carried by the conveyor 62, under control by the side conveyors 90, through a heating station in which hot air issuing from elongate nozzles 101, 102 fed from manifolds 103 (FIGS. 9, 10C) is directed horizontally against, respectively, the underside of the tabs 44 and the exterior surfaces of the coupler 9 along the sides of the multipack path. The hot air is generated by heat exchangers 150 (FIGS. 8, 9) with an associated blower (not shown) in the manner described in U.K. Pat. No. 1,071,040 to which the readers attention is directed. It is of sufficient temperature and is applied for a sufficient length of time to cause plastics material of the tabs and of the coupler to fuse and so enable a heat-seal bond to be subsequently formed between them as will later be seen.

Figure 10C:
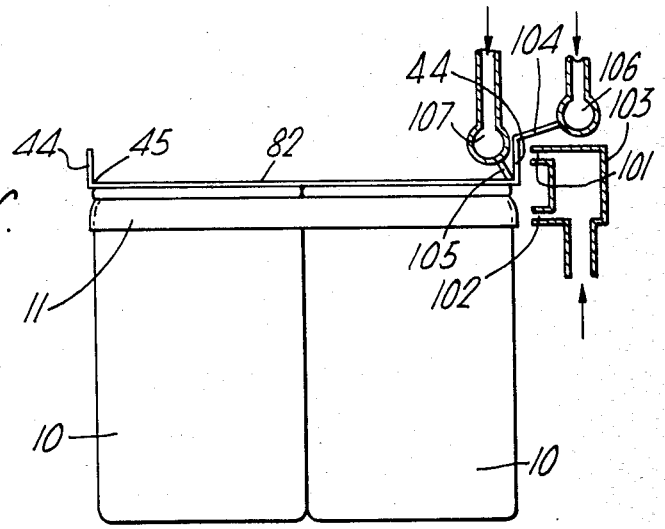

As is apparent from FIG. 10C, the hot air is applied to the tabs 44 when they are held in uplifted, vertically extended positions by plough bars 104 of which one extends along each side of the conveyor 62 accommodated by the cutaways 96 in the dogs 92. Further bars 105 engage the upper surface of the blank so as to provide downward restraint for the blank at the elbows formed along the hinge lines 45.

The bars 104, 105 are carried and cooled by rails 106, 107 fed with cooling water from a supply source (not shown). They are shaped so that as the multipack and blank move along them they progressively bend the tabs 44 of the blank up from their original horizontal positions of FIG. 10A, and through the inclined position shown in FIG. 10B to the vertical position of FIG. 10C at which heating by the hot air takes place.

Figure 10D:
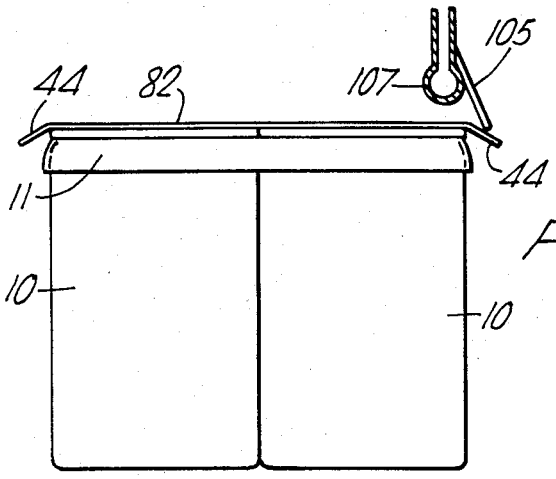
Figure 10E:
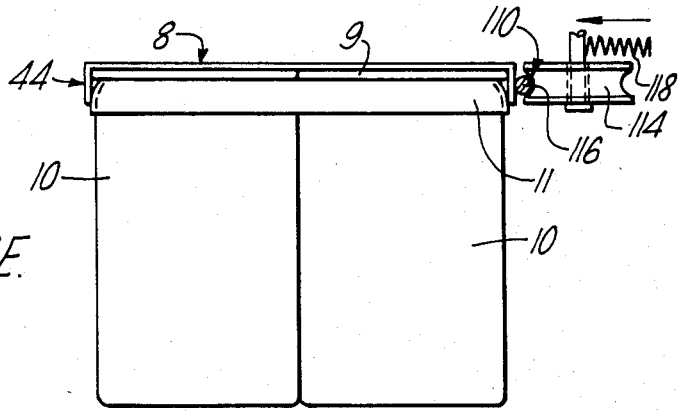

After the heating has been accomplished, further movement of the multipack and blank carries them past the downstream end of the bars 104 so that continuations of the bars 105 can subsequently bend the tabs 44 progressively to a substantially downwardly extending position. FIG. 10D shows an intermediate position of the tabs 44 during this movement. For clarity the items 101 to 107 are omitted from the left hand side of each of FIGS. 10A to 10E.

It will therefore be understood that on leaving the bars 105 the blank has its tabs 44 inclined downwardly; moreover, the tabs and the opposed surfaces presented by the coupler 11 are still in a hot, heat-sealable condition. Heat-sealing between the tabs and the coupler is achieved by endless pressure belts 110 trained about pulleys 111 and 112 at their upstream and downstream ends, and about idler pulleys 115.

The pressure belts are of circular cross-section and made of a single strand of a plastics material having substantial elasticity e.g. polypropylene. The pulleys 111 are mounted for rotation about aligned and transverse, horizontal axes, whereas the pulleys 112 are rotatable about vertical axes and drivable from the drive motor 67 via the gearbox 113 previously mentioned. The circulating speed of the pressure belts 110 is the same as that of the side conveyors 90 so as not to exert any force tending to tear the relatively fragile tabs 44 along their hinge lines 45.

For each pressure belt 110 the pulleys are arranged so that the lower run of the belt lies in the horizontal plane of the median line of the downfolded tabs 44. Smaller idler pulleys 114 biassed inwardly by springs 118 (see FIG. 10E), further constrain an upstream portion 116 of the lower run to circulate against the tabs 44, so pressing them into heat-sealed relation with the coupler 11 and holding them in that position until the heat-seal is permanently formed.

After leaving the pressure belts 110 and, at the same time, the side conveyors 90, the multipacks, with their cover and display attachments 8 in position as shown, continue along the conveyor 62 for subsequent dispatch and distribution.

The invention is not limited to application to multipacks of necked-in beverage cans having double-seamed easy-open end closures as particularly described. It may have application to multipacks of other types of container but joined, as before, by a sheet plastics coupler engaged behind projections on the containers.

The cover and display attachment may be of plastics sheet material rather than plastics coated cartonboard (or other paper-based material) as particularly described.

We claim:

1. Apparatus for attaching blanks of a heat-sealable sheet material to multipacks each comprising a plurality of containers in an array and a sheet plastics coupler having apertures through which end closures of the containers project and which are dimensioned so that the containers are tightly held by tension in the coupler material, each blank having a plane portion by which it overlies and substantially covers the end closures of a said multipack and a plurality of tabs integrally joined to the plane portion along two opposed sides thereof and foldable downwardly in relation to the plane portion to heat sealed connection with the coupler along opposed sides of the multipack, the apparatus comprising conveyor means for transporting a succession of said multipacks along a generally horizontal path, a reservoir for plurality of said blanks, applicator means operating in timed relation to said conveyor means to place blanks individually upon said multipacks moving along said conveyor means with the tabs of said blanks disposed laterally in relation to the conveyor path and, along each side of the conveyor path, heating means for directing hot gas onto said tabs and onto the lateral surfaces of said coupler whereby to render them heat-sealable together, folding means for folding the tabs downwardly adjacent said lateral surfaces of the coupler, and pressure means for holding the tabs against the coupler to heat-seal the same together, said conveyor means comprising a locating side conveyor disposed to receive the multipacks wit the blanks thereon downstream of the applicator means and having dog members arranged to engage individual multipacks between adjacent containers within said individual multipacks, so as to locate the multipacks as they are carried in substantially continuous succession through the heating means, folding means and pressure means, each dog of the locating side conveyor being arranged to engage both a multipack and the respective blank thereon so as to locate the blank in relation to the multipack until the heat-seals have been made.

2. Apparatus according to claim 1, wherein the conveyor means further comprises a bottom conveyor operating at a first speed and arranged to carry the multipacks through the apparatus between input and discharge ends, and a metering side conveyor disposed intermediate the ends of the bottom conveyor and operated at a second speed which is smaller than the first speed so as to hold a plurality of the multipacks in abutting relation and to feed them onwards at said second speed to said applicator means.

3. Apparatus according to claim 2, wherein the metering side conveyor has dog members with a pitch equal to the multipack length and arranged to engage between the multipacks.

4. Apparatus according to claim 2, wherein the locating side conveyor is operated at said second speed so that the heating means, folding means and pressure means are effective upon multipacks in abutting relationship.

5. Apparatus according to claim 1, further including an additional folding means arranged upstream of the heating means to fold the tabs into vertically uplifted positions, the heating means comprising upper and lower nozzles arranged to direct hot gas horizontally onto respectively, said vertically uplifted tabs and said lateral surfaces of the coupler.

6. Apparatus according to claim 1, wherein said folding means comprises plough bars arranged to fold the tabs into vertically uplifted positions upstream of the heating means, to maintain the tabs in the uplifted positions during passage of the multipacks past the heating means, and, downstream of the heating means, to fold the tabs downwardly to substantially vertical positions at which the pressure means may be effective, the heating means comprising upper and lower nozzles arranged to direct hot gas horizontally onto, respectively, said vertically uplifted tabs and said lateral surfaces of the coupler.

7. Apparatus according claim 1, wherein the pressure means comprises an endless belt arranged to circulate at the speed of the multipacks as they pass along the conveyor means, the belt being biassed inwardly and resiliently into engagement with the tabs.

* * * * *